US005631728A

United States Patent [19]

Rushing et al.

[11] Patent Number: 5,631,728

[45] Date of Patent: May 20, 1997

[54] PROCESS CONTROL FOR ELECTROPHOTOGRAPHIC RECORDING

[75] Inventors: Allen J. Rushing, Webster; Matthias H. Regelsberger, Rochester, both of N.Y.

[73] Assignee: Eastman Kodak Company, Rochester, N.Y.

[21] Appl. No.: 594,955

[22] Filed: Jan. 31, 1996

[51] Int. Cl.[6] ..... G03G 21/00

[52] U.S. Cl. ..... 399/59; 399/51

[58] Field of Search ..... 355/200, 203, 355/204, 208, 210, 245, 246

[56] References Cited

U.S. PATENT DOCUMENTS

| | | | |
|---|---|---|---|
| 4,473,029 | 9/1984 | Fritz . | |
| 4,546,060 | 10/1985 | Miskinis . | |
| 4,647,184 | 3/1987 | Russell et al. . | |
| 4,853,738 | 8/1989 | Rushing . | |
| 5,036,360 | 7/1991 | Paxon et al. | 355/208 |
| 5,087,942 | 2/1992 | Rushing . | |
| 5,099,279 | 3/1992 | Shimizu | 355/208 |
| 5,253,934 | 10/1993 | Potucek et al. . | |
| 5,257,039 | 10/1993 | Chung et al. . | |
| 5,300,960 | 4/1994 | Pham et al. . | |
| 5,315,351 | 5/1994 | Matsushiro et al. | 355/246 |
| 5,315,352 | 5/1994 | Nakane et al. | 355/246 |
| 5,321,468 | 6/1994 | Nakane et al. | 355/208 |
| 5,436,705 | 7/1995 | Raj . | |

OTHER PUBLICATIONS

U.S. pat. appli. 08/581,025, filed Dec. 28, 1995 in the name of Donohue et al entitled "LED Printhead and Driver Chip for use therewith having Boundary Scan Test Architecture".

U.S. pat. applic. 08/580,263, filed Dec. 28, 1995 in the name of Y.S. Ng et al and entitled "Apparatus and Method for Grey Level Printing with Improved Correction of Exposure Parameters".

*Primary Examiner*—Sandra L. Brase

*Attorney, Agent, or Firm*—Norman Rushefsky

[57] ABSTRACT

In an electrophotographic apparatus, an apparatus and method is provided for controlling reproduction by controlling adjustments to the parameters $V_o$ and $E_o$. A density parameter $D_{OUT}$ of an exposed and developed maximum density patch is measured. An error, $\Delta D_{OUT}$, in the measured density parameter is calculated from a density setpoint. The error, $\Delta D_{OUT}$ is multiplied by first and second constants to obtain respective adjustment values used for adjusting $E_o$ and $V_o$. The control operation is repeated periodically to provide new adjustment values that are used for adjusting $E_o$ and $V_o$ and a fixed ratio is always maintained between the first and second constants.

16 Claims, 4 Drawing Sheets

PROCESS CONTROL FOR ELECTROPHOTOGRAPHIC RECORDING

BACKGROUND OF THE INVENTION

1. Field of the Invention

This invention relates to electrophotographic document copiers and/or printers and more particularly to automatic adjustment of parameters influencing reproduction of such copiers and/or printers.

2. Description of the Prior Art

In electrophotographic copiers and/or printers, contrast density and color balance (in color machines) can be adjusted by changing certain process control parameters such as primary voltage $V_o$, exposure $E_o$ and development station bias voltage $V_B$, the concentration of toner in the development mixture and the image transfer potential.

Control of such parameters is often based on measurements of the density of a toner image in a test patch. Typically, the test patch can be recorded on an area of the electrophotoconductive imaging member between adjacent image frames and developed. The developed density of the patch can be measured and adjustments made accordingly.

In U.S. Pat. No. 5,087,942, there is disclosed a copier for copying transparencies wherein a patch is optically exposed on a photoconductor using a first light source and developed. The density of the patch is measured and compared to target values set during manufacture to maintain process control parameters. In order to adjust $E_o$, the patent suggests that $E_o$ be adjusted by comparing the measured density value with aim density values and adjusting the illumination from a second light source that is used to illuminate the transparency for making the reproduction. A problem with this approach is the use of a separate light source to record the patches since it is desirable to have closed loop control of the exposure by having the same exposure source that is creating the patch be used for printing the images. Another drawback is that only the $E_o$ control parameter is adjusted. While this approach may regulate a single density level well, good regulation of the entire tone scale generally requires adjustment of at least 2 process control parameters; e.g., $E_o$ and $V_o$, and $V_B$.

U.S. Pat. No. 4,647,184 discloses an electrophotographic printing apparatus which includes controls for establishing basis xerographic parameters to produce optimum copy quality. In this apparatus, adjustments in exposure and charging parameters are provided for by producing patches at a maximum density, an intermediate density and a minimum density. An undesirable feature of this type of control is the added complexity of rendering multiple patches at different densities, measuring the different densities, providing calculations at each of the measured densities and then providing an iterative process for which optimum values for the parameters are obtained.

U.S. Pat. No. 5,436,705 discloses an adaptive controller for controlling a plurality of process parameters in an electrophotographic printing machine. A toner area coverage sensor detects a plurality of different density level values for a toner image and generates corresponding signals. These signals are compared with reference signals at each of the density levels and the differences or errors are input to a linear quadratic controller to compute new values to provide adjustments to the various parameters. Again, the use of patches at various density levels provides an added complexity which requires wasting of toner and provides extra wear on the cleaning apparatus which is operated to remove toned patches from the photoconductor. Furthermore, customer image productivity may be compromised in order to print the multiple test patches.

U.S. Pat. No. 4,853,738 also discloses the use of multiple test patches of different densities for controlling two adjustable process control parameters such as $V_o$ and $E_o$. A complex calculation involving a matrix of values associated with each of the measured densities adds calculation complexity and, as noted above, requires waste of toner and extra wear on the cleaning apparatus.

It is therefore an object of the invention to provide a process control method and apparatus which compensates well for tone scale shifts caused by changing environmental conditions and rest/run effects, requires fewer printed process control patches than other feedback strategies, reduces range requirements for $V_o$ and $E_o$. and is robust over material variations, i.e., different toner compositions.

SUMMARY OF THE INVENTION

In accordance with one aspect of the invention, there is provided a reproduction apparatus comprising an electrostatic recording member for supporting an electrostatic image; charging means for establishing a primary charge on the member, the primary charge being defined by a parameter $V_o$; exposure means for image-wise modulating the primary charge to form an electrostatic image on the recording member and having an exposure parameter $E_o$; developer means for developing the electrostatic image; and control means for controlling adjustments to the parameters $V_o$ and $E_o$ by measuring a density parameter $D_{OUT}$ of an exposed and developed area that is formed by operation of said charging means, said exposure means and said developer means, said control means including means for calculating an error, $\Delta D_{OUT}$, in the measured density parameter from a density setpoint and multiplying $\Delta D_{OUT}$ by first and second constants to obtain respective adjustment values used for adjusting $E_o$ and $V_o$ and wherein in repeated use of said control means to provide repeated adjustment values used for adjusting $E_o$ and $V_o$ a fixed ratio is maintained between said first and second constants.

In accordance with another aspect of the invention, there is provided a method of controlling reproduction of images comprising the steps of (a) charging an electrostatic recording member with a primary charge defined by a parameter $V_o$; (b) modulating the primary charge on the recording member with an exposure device to form an exposed test area, the exposure device having an exposure parameter $E_o$; (c) developing the exposed test area; and (d) controlling adjustments to the parameters $V_o$ and $E_o$ by measuring a density parameter $D_{OUT}$ of the exposed and developed test area, calculating an error, $\Delta D_{OUT}$, in the measured density parameter from a density setpoint, and multiplying $\Delta D_{OUT}$ by first and second constants to obtain respective adjustment values used for adjusting $V_o$ and $E_o$; and (e) repeating steps (a) through (d) to provide repeated adjustment values used for adjusting $V_o$ and $E_o$ wherein in the repeating of steps (a) through (d) a fixed ratio is maintained between said first and second constants.

BRIEF DESCRIPTION OF THE DRAWINGS

In the detailed description of the preferred embodiments of the invention presented below, reference is made to the accompanying drawings in which.

DESCRIPTION OF THE PREFERRED EMBODIMENTS

The present invention is described below in the environment of an electrophotographic copier and/or printer. However, it will be noted that although this invention is suitable for use with such machines, it also can be used with other types of electrophotographic copiers and printers.

Because apparatus of the general type described herein are well known the present description will be directed in particular to elements forming part of, or cooperating more directly with, the present invention.

To facilitate understanding of the foregoing, the following terms are defined:

$V_B$=Development station electrode bias.

$V_o$=Primary voltage (relative to ground) on the photoconductor as measured just after the primary charger. This is sometimes referred to as the "initial" voltage.

$E_o$=Light produced by the printhead to form a density $D_{MAX}$.

Figure 1:
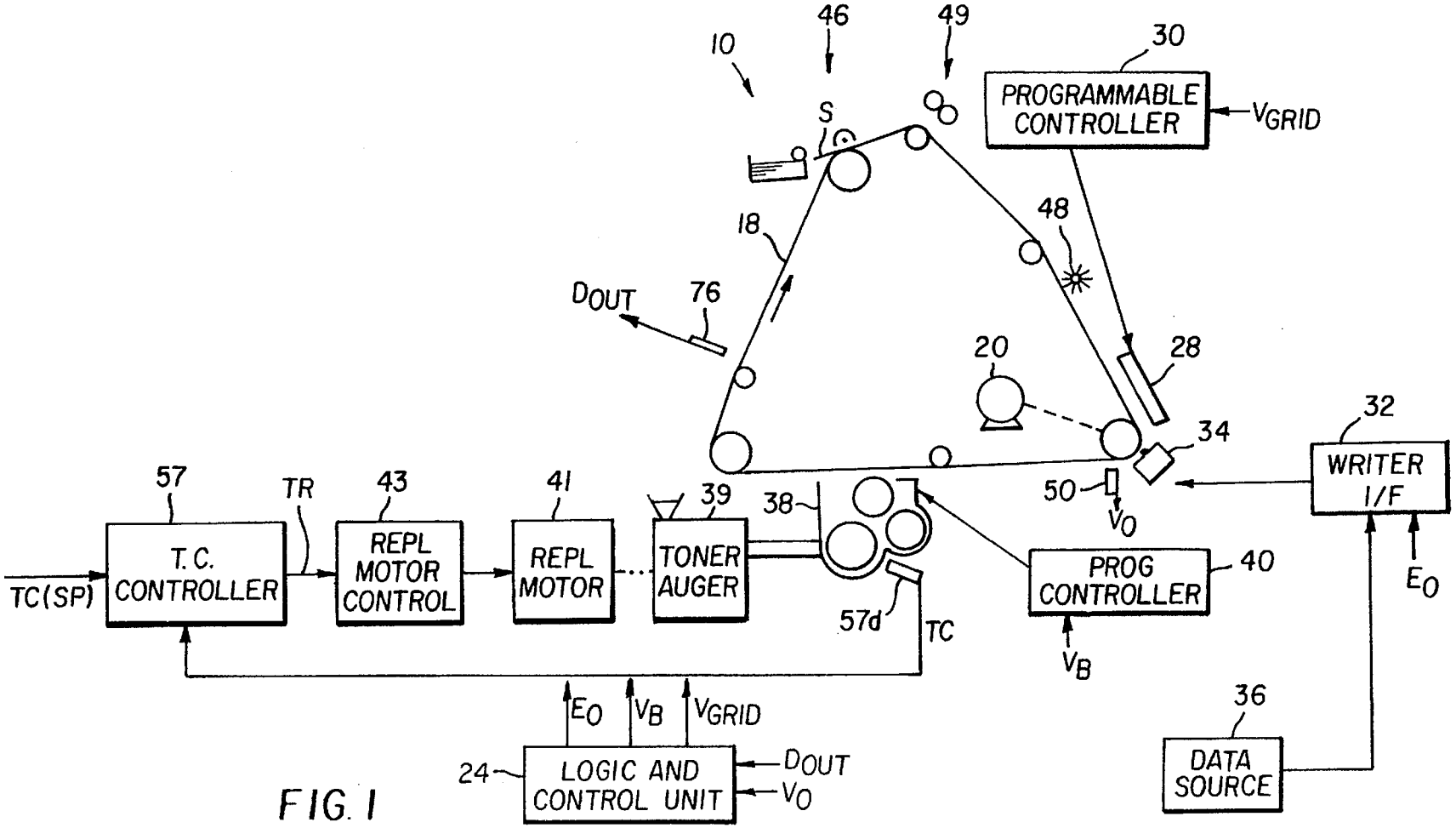
FIG. 1 is a schematic showing a side elevational view of an electrostatographic machine in which the present invention is useful.

With reference to the machine 10 as shown in FIG. 1, a moving recording member such as photoconductive belt 18 is driven by a motor 20 past a series of work stations of the printer. A logic and control unit (LCU) 24, which has a digital computer, has a stored program for sequentially actuating the various work stations.

Briefly, a charging station 28 sensitizes belt 18 by applying a uniform electrostatic charge of predetermined primary voltage $V_o$ to the surface of the belt. The output of the charger is regulated by a programmable controller 30, which is in turn controlled by LCU 24 to adjust primary voltage $V_o$ for example through control of electrical potential ($V_{GRID}$) to a grid that controls movement of charged particles, created by operation of the charging wires, to the surface of the recording member as is well known.

At an exposure station 34, projected light from a write head dissipates the electrostatic charge on the photoconductive belt to form a latent image of a document to be copied or printed. The write head preferably has an array of light-emitting diodes (LEDs) or other light source such as a laser for exposing the photoconductive belt picture element (pixel) by picture element with an intensity regulated in accordance with signals from the LCU to a writer interface 32 that includes a programmable controller. Alternatively, the exposure may be by optical projection of an image of a document or a patch onto the photoconductor. It is preferred that the same source that creates the patch used for process control to be described below also exposes the image information.

Where an LED or other electro-optical exposure source is used, image data for recording is provided by a data source 36 for generating electrical image signals such as a computer, a document scanner, a memory, a data network, etc. Signals from the data source and/or LCU may also provide control signals to a writer network, etc. Signals from the data source and/or LCU may also provide control signals to the writer interface 32 for identifying exposure correction parameters in a look-up table (LUT) for use in controlling image density. In order to form patches with density, the LCU may be provided with ROM memory or other memory representing data for creation of a patch that may be input into the data source 36. Travel of belt 18 brings the areas bearing the latent charge images into a development station 38. The development station has one (more if color) magnetic brushes in juxtaposition to, but spaced from, the travel path of the belt. Magnetic brush development stations are well known. For example, see U.S. Pat. Nos. 4,473,029 to Fritz et al and 4,546,060 to Miskinis et at.

LCU 24 selectively activates the development station in relation to the passage of the image areas containing latent images to selectively bring the magnetic brush into engagement with or a small spacing from the belt. The charged toner particles of the engaged magnetic brush are attracted imagewise to the latent image pattern to develop the pattern.

As is well understood in the art, conductive potions of the development station, such as conductive applicator cylinders, act as electrodes. The electrodes are connected to a variable supply of D.C. potential $V_B$ regulated by a programmable controller 40. Details regarding the development station are provided as an example, but are not essential to the invention.

A transfer station 46, as is also well known, is provided for moving a receiver sheet S into engagement with the photoconductor in register with the image for transferring the image to a receiver. Alternatively, an intermediate member may have the image transferred to it and the image may then be transferred to the receiver. A cleaning station 48 is also provided subsequent to the transfer station for removing toner from the belt 18 to allow reuse of the surface for forming additional images. In lieu of a belt a drum photoconductor or other structure for supporting an image may be used. After transfer of the unfixed toner images to a receiver sheet, such sheet is transported to a fuser station 49 where the image is fixed.

The LCU provides overall control of the apparatus and its various subsystems as is well known. Programming commercially available microprocessors is a conventional skill well understood in the art. The following disclosure is written to enable a programmer having ordinary skill in the art to produce an appropriate control program for such a microprocessor. In lieu of only microprocessors the logic operations described herein may be provided by or in combination with dedicated or programmable logic devices.

Process control strategies generally utilize various sensors to provide real-time control of the electrostatographic process and to provide "constant" image quality output from the user's perspective.

One such sensor may be a densitometer 76 to monitor development of test patches in non-image areas of photoconductive belt 18, as is well known in the art. The densitometer is intended to insure that the transmittance or reflectance of a toned patch on the belt is maintained. The densitometer may consist of an infrared LED which shines through the belt or is reflected by the belt onto a photodiode. In the preferred embodiment, the patch nominal density is at the high density ($D_{MAX}$) end of the time scale, and the densitometer is of the transmission type. A densitometer signal with high signal-to-noise ratio is obtained in the preferred embodiment, but a lower nominal density level and/or a reflection densitometer would be reasonable alternatives in other configurations. The photodiode generates a voltage proportional to the amount of light received. This voltage is compared to the voltage generated due to transmittance or reflectance of a bare patch, to give a signal representative of an estimate of toned density. This signal $D_{OUT}$ may be used to adjust $V_o$, $E_o$, or $V_B$; and to assist in the maintenance of the proper concentration of toner particles in the developer mixture.

In the preferred embodiment, the density signal is used to detect short term changes in density of a measured patch to control primary voltage $V_o$, exposure $E_o$, and/or bias voltage $V_B$. To do this, $D_{OUT}$ is compared with a set point density value or signal $D_{sp}$ and differences between $D_{OUT}$ and $D_{sp}$ cause the LCU to change settings of $V_{GRID}$ on charging station 28 and adjust exposure $E_o$ through modifying exposure duration or light intensity for recording a pixel. Adjustment to the potential $V_B$ at the development station is also provided for. These changes are in accordance with the invention described below.

In accordance with the invention described in commonly assigned U.S. application Ser. No. 60/002,661, filed Aug. 22, 1995 in the names of Rushing et al, long-term changes in toning contrast may be compensated for by adjustment of the toner concentration setpoint TC (SP) of a toner concentration (TC) controller 57. The TC controller, in turn, adjusts the short term rate of toner replenishment. In a two-component developer provided in development or toning station 38, toner gets depleted with use whereas magnetic carrier particles remain thereby affecting the toner concentration in the development station. Addition of toner to the development station may be made from a toner replenisher device 39 that includes a source of toner and a toner auger for transporting the toner to the development station. A replenishment motor 41 is provided for driving the auger. A replenishment motor control circuit 43 controls the speed of the auger as well as the times the motor is operating and thereby controls the feed rate and the times when toner replenishment is being provided. Typically, the motor control 43 operates at various adjustable duty cycles that are controlled by a toner replenishment signal TR that is input to the replenishment motor control 43. Typically, the signal TR is generated in response to a detection by a toner monitor of a toner concentration that is less than that of a set point value. For example, a toner monitor probe **57*d*** is a transducer that is located or mounted within or proximate the development station and provides a signal TC related to toner concentration. This signal is input to a toner monitor which in a conventional toner monitor causes a voltage signal $V_{MON}$ to be generated in accordance with a predetermined relationship between $V_{MON}$ and TC. The voltage $V_{MON}$ is then compared with a fixed voltage of say 2.5 volts which would be expected for a desired toner concentration of say 10%. Differences of $V_{MON}$ from this fixed voltage are used to adjust the rate of toner replenishment or the toner replenishment signal TR. In a more adjustable type of toner monitor such as one manufactured by Hitachi Metals, Ltd., the predetermined relationship between TC and $V_{MON}$ offers a range of relationship choices. With such monitors, a particular parametric relationship between TC and $V_{MON}$ may be selected in accordance with a voltage input representing a toner concentration set point signal value, TC(SP). Thus changes in TC(SP) can affect the rate of replenishment by affecting how the system responds to changes in toner concentration that is sensed by the toner monitor.

While the above approach suggested for the control of toning contrast by control of toner concentration works well to gradually compensate the long-term effects of developer aging, the invention described herein is directed to compensating short-term environmental changes and rest/run effects by control of $V_o$ and $E_o$ and is sufficiently robust as to be useable with other techniques for controlling toning contrast and for controlling toner concentration.

Figure 2:
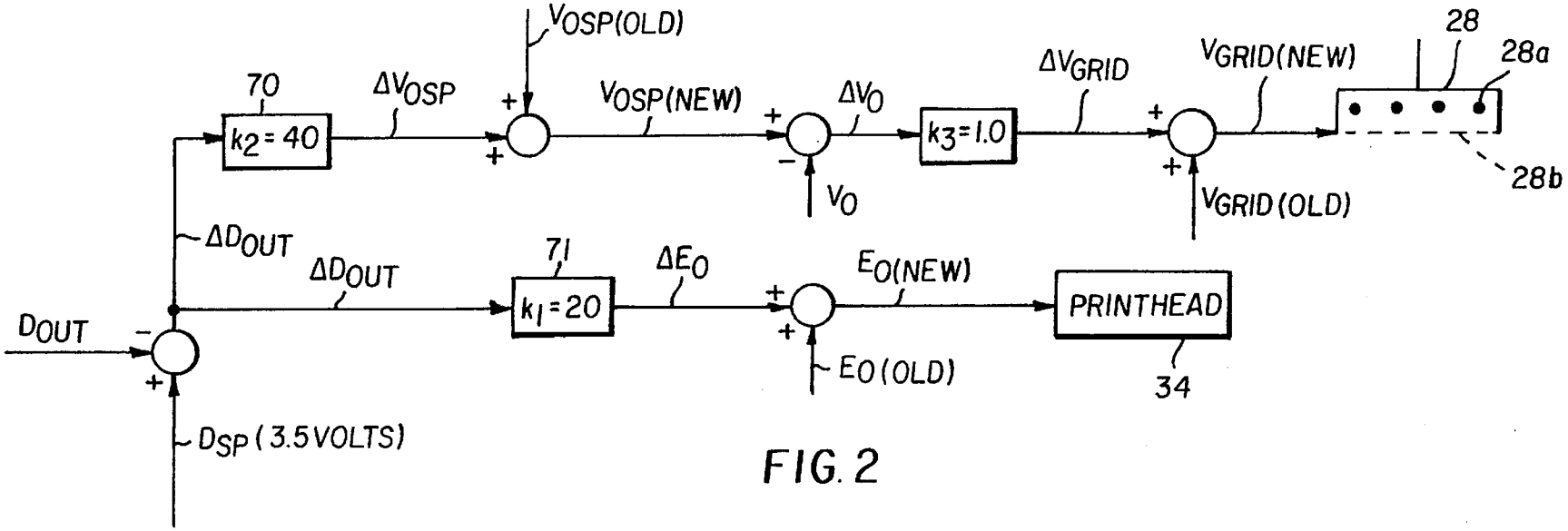
FIG. 2 is a schematic of an algorithm for control of $V_o$ and $E_o$ in the apparatus of FIG. 1.

With reference now to FIG. 2, there is shown a programmable controller for controlling parameters $V_o$, generated by the primary corona charger 28, and $E_o$ generated by the LED printhead 34 of FIG. 1. As is well known, control of $V_o$ is advantageously provided for by adjustment of the potential to a grid **28*b* in those primary chargers which employ such a grid. With such chargers, corona or charged ions generated by the corona wires 28*a*, which are at an elevated potential level, are caused to pass through the grid to an insulating layer on the photoconductor, which photoconductor is otherwise grounded. The charge level builds on this insulating layer to a level proximate that of the potential on the grid. Thus $V_{GRID}$, the potential on the grid, provides a reasonably close correspondence to the primary charge $V_o$ created on the photoconductor. Other primary chargers that do not employ a grid may also be used. Control of $E_o$ is preferably made by control of current to an electronic exposure source such as LED printhead 34. Examples of LED printheads are described in U.S. Pat. Nos. 5,253,934; 5,257,039 and 5,300,960 and U.S. applications Ser. No. 08/581025, filed Dec. 28, 1995 in the names of Michael J. Donahue et al and entitled "LED Printhead and Driver Chip For Use Therewith Having Boundary Scan Test Architecture" and Ser. No. 08/580263, filed Dec. 28, 1995 in the names of Yee S. Ng et al and entitled "Apparatus and Method for Grey Level Printing with Improved Correction of Exposure Parameters." In the references just described, there are illustrated examples of LED printheads which are formed of plural chip arrays arranged in a single row. Typically, 64, 96, 128 or 196 LEDs are arranged on a chip array in a row and when the chip arrays are in turn arranged on a printhead support, a row of several thousand LEDs is provided that is made to extend across, and preferably perpendicular, to the direction of movement of the photoconductor. Desirably, the number of LEDs (typically five to six thousand) are such so as to extend for the full width or available recording width of the photoconductor so that the LED printhead may be made stationary. The LEDs are typically fabricated to be pitched at 1/300th or better yet 1/600th to the inch in the cross-track dimension of the photoconductor. Control of current and selective enablement is provided by driver chips that are also mounted on the printed. Typically, one or two driver chips are associated with each LED chip array to provide a controlled amount of current to an LED selected to record a particular pixel at a particular location on an image frame of the photoconductor. Since LED printing is conventional, further details are either well known or may be obtained from the aforementioned references. In control of current to each LED for recording a pixel, the above patent literature notes that two parameters may be used. One of the parameters referred to in this literature has to do with a global adjustment parameter or capability for the LED printhead. With a global adjustment capability, which we may call "$G_{REF}$" (also known in the patent literature as $V_{REF}$) there is provided the ability to change by a certain amount current generated by the driver chips for driving LEDs selected to be enabled. The LED printheads disclosed in the above patent literature may also have a local adjustment capability ($L_{REF}$) that may be used to adjust current generated by some driver chips differently than current generated by others. The reasons for providing both global and local current adjustment capability is that LED driver chips and LEDs on certain chips may vary from batch to batch due to process differences during manufacture. When the LED printhead is manufactured, these process differences may be accommodated for by allowing selection of different currents generated by different driver chips on the same printhead. In addition, if a printhead while in use has temperature differentials on the printhead, provision may be made for controlling current to a different extent for each driver chip. However, due to aging of the printhead and/or changes in elecrophotographic process conditions, global changes to driver current are advantageously provided for in order to change the parameter $E_o$. In a system which employs discharge area development, exposure of a pixel area by an LED will cause that pixel area to be developed. The more the exposure, the greater the density until an exposure is provided that provides a maximum development capability. Thus, for example, to create a patch of density $D_{MAX}$, a block of many LEDs similarly illuminated can create an exposed patch area on the photoconductive belt 18**.

Figure 3:
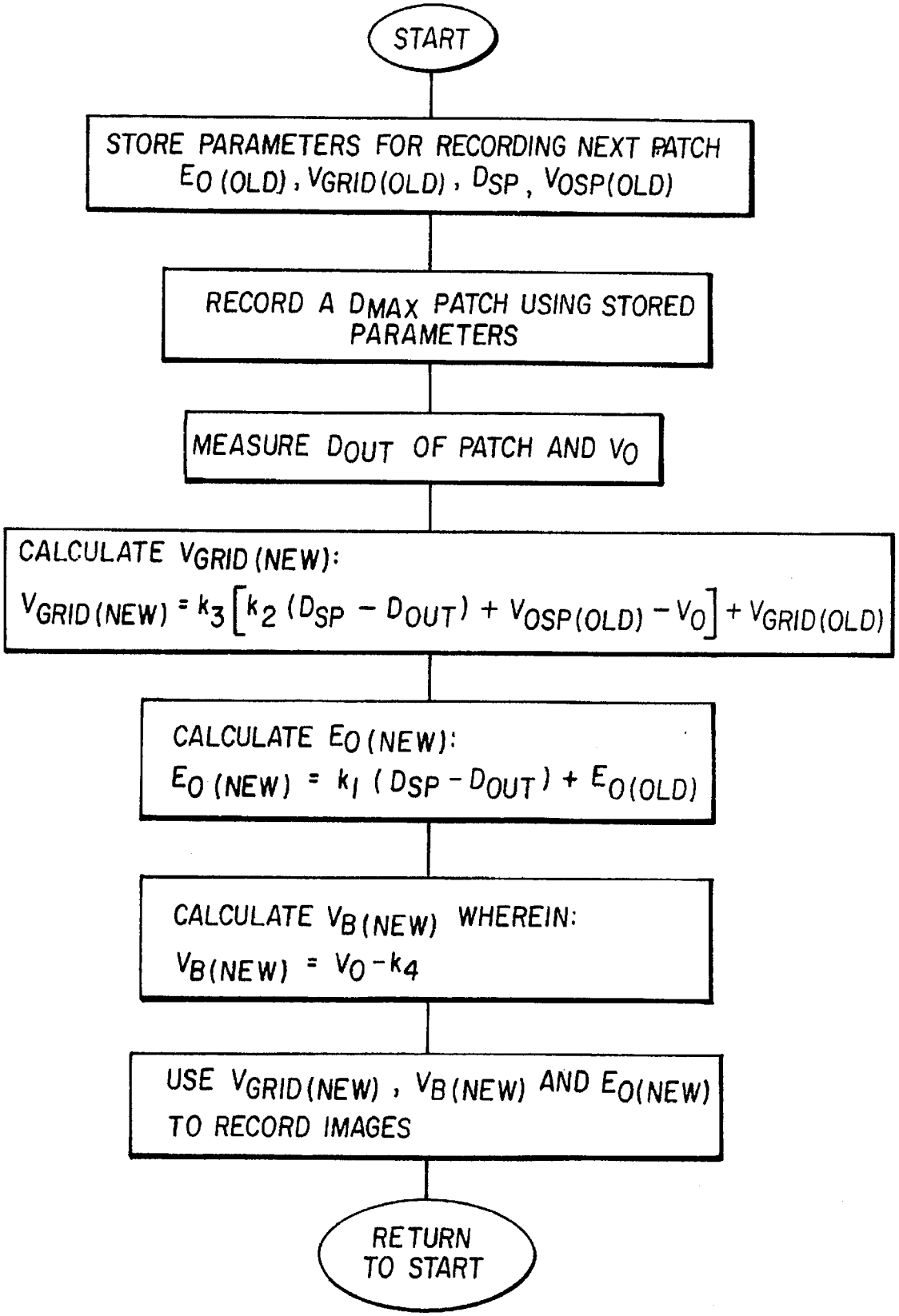
FIG. 3 is a flowchart of a program operative for determining new values of $V_o$ and $E_o$ during operation of the apparatus of FIG. 1.

With reference now to FIGS. 2 and 3, the apparatus of FIG. 1 under control of the programmed logic and control unit 24 causes a calibration mode to be entered every few image frames; for example, every 5 or 6 image frames. In this mode, parameters used for recording a next set of patches each of $D_{MAX}$ density are stored in memory. The set of patches may be in an interframe area on the photoconductor and several may be recorded throughout the width of the photoconductor to ensure similar operation of selected groups of LEDs. The typical parameters of interest are $E_o$, $V_{GRID}$, $D_{sp}$ (set point for maximum densitometer output typically is 3.5 volts when transmission densitometer output is measured and a deduction taken for losses through the transparent photoconductor). After a $D_{MAX}$ patch or set of $D_{MAX}$ patches is recorded, $D_{OUT}$ of the patch and $V_o$ on the photoconductor in a non-exposed area are measured. The difference between $D_{OUT}$ and $D_{sp}$ are used to generate an error signal $\Delta D_{OUT}$. In accordance with the invention, this error signal is multiplied in respective multipliers 70, 71 by two constants $k_1$ and $k_2$ having a fixed ratio, in this example, $k_2/k_1=2.0$. Also, in the preferred example, $k_2=40$ and $k_1=20$. For adjustments to $V_o$, multiplying of $k_2$ by 40 indicates a needed change to the $V_o$ set point print $V_{OSP}$ and identified as $\Delta V_{OSP}$. The change in $V_{OSP}$, $\Delta V_{OSP}$, is then added to (or if a negative change subtracted from) $V_{OSP}$ used to create the patch ($V_{OSP(OLD)}$) to generate a new $V_o$ set point signal, $V_{OSP(NEW)}$. The difference between a signal representing $V_{OSP(NEW)}$ and a signal representing measured $V_o$, which is used to create the patch, generates an error signal $\Delta V_o$. The signal representing $\Delta V_o$ is multiplied by a parameter $k_3$; in this case, $k_3=1.0$ to change a required change to the grid voltage level or $\Delta V_{GRID}$. A signal representing $\Delta V_{GRID}$ is then added (or subtracted) to the grid voltage used to generate the patch $V_{GRID(OLD)}$ to create a new $V_{GRID(NEW)}$ voltage that may be used for recording the next few image frames until a further adjustment is indicated by routine repetition of this process through creating of new patches and wherein the present new parameter values become the old parameter values.

The signal output from multiplier 71 represents an adjustment in $E_o$ and is identified as $\Delta E_o$. A signal representing $\Delta E_o$ is added to (or subtracted from) a signal representing the $E_o$ value used to create the patch $E_{o(OLD)}$. In this example, $E_o$ and $\Delta E_o$ are in terms of parameters used to generate current to the LEDs and more specifically $G_{REF}$ and $\Delta G_{REF}$ which is a change to the parameter $G_{REF}$. As noted in the above patent literature, a value $G_{REF}$ can be a digital value stored in a register on each of the driver chips. This digital value is used to enable certain transistors to control levels of current generated in a current generating circuit of the driver chips. Preferably, the values $G_{REF}$ and $L_{REF}$ (also referred to in the patent literature as $R_{REF}$), through selective enablement of certain transistors, control current generated in a master circuit wherein the LED driver channels are driven by slave circuits that are slaved off the master circuit. However, the value $E_o$ is shown generally in FIG. 2 because the invention has broader applicability to other printers or exposure sources that do not use values of $G_{REF}$ to control $E_o$ and might even feature analog control of $E_o$, or as noted above, could be from an optical exposure. The signal representing $\Delta E_o$ is added to the value of $E_{o(OLD)}$ (or $G_{REF(OLD)}$ specifically) used to create the patch to generate a signal representing a new value $E_o$ or $E_{o(NEW)}$ to be used along with the new value of $V_{GRID}$, or $V_{GRID(NEW)}$ for recording the next few image frames for making copies or producing prints until the control process is repeated for producing adjustments thereto.

In FIG. 3, a flowchart of a program is illustrated identifying an equivalent calculation which can be made by either using software or hardware calculators. In addition to calculating $E_{o(NEW)}$ and $V_{GRID(NEW)}$, a new value for use as a voltage bias to the development station $V_{B(NEW)}$ is generated by the relationship of $V_{B(NEW)}=V_o-k_4$, wherein $k_4$ is a constant. It is well known that control of an electrophotographic process is provided by having a constant difference maintained between $V_o$ and $V_B$.

Figure 4:
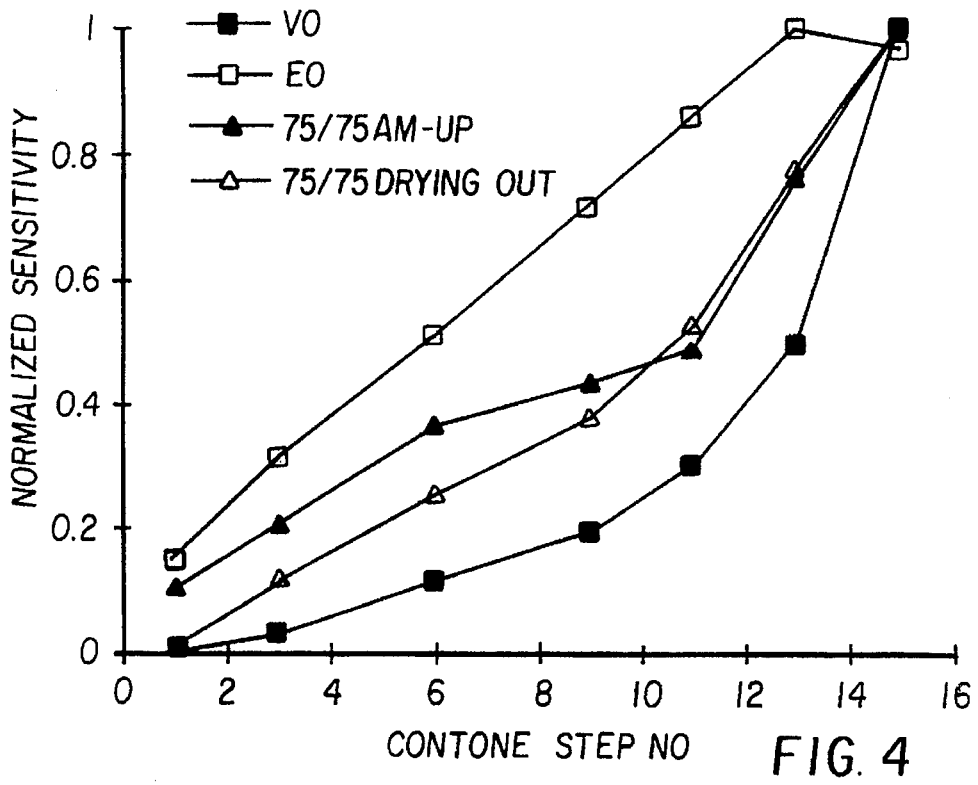
FIG. 4 is a graph illustrating $V_o$ and $E_o$ in terms of density over the tone scale for a particular developer.

With reference now to FIG. 4, an unheated toning system having a two-component toner was tested for environmental and rest-run stability.

Tone scale regulation was provided by automatic adjustment of $V_o$ (and feedforward to $V_B$) at fixed $E_o$ of approximately 7 ergs/cm$^2$ (at high fixed $G_{REF}=200$). $V_o$ ranged from 310 volts (80° F./10% relative humidity (RH) steady-state) to a $V_o$ of 640 volts (a few hundred prints into the morning startup (AM-UP) at 75° F./75%RH). With this, the $D_{MAX}$ process control patch was well regulated but the rest of the contone tone scale was noted to have substantial instability (within the worst case 75° F./75%RH environment). Initially, in the AM-UP the mid-tone steps get lighter as the developer charge equilibrates to the high-RH environment; then darker as the developer approaches the steady state dried-out condition.

Environmental testing was repeated, this time using automatic $E_o$ adjustments in the range of approximately 3.6 to 7.9 ergs/cm$^2$ ($G_{REF}=0$ to $G_{REF}=245$) and a fixed $V_o$ ($V_{OSP}=600$, with feedback control to $V_{GRID}$). The $G_{REF}$ range required was 0 (80° F./10%RH steady-state) to 245 (a few hundred prints into the AM-UP at 75° F./75%RH). Note that at $G_{REF}=0$ there is still some light output by the LEDs. Again, $D_{MAX}$ was well regulated, but the rest of the tone scale was not (within the worst case 75° F./75%RH environment). Initially, in the AM-UP the mid-tone steps get darker as the developer charge equilibrates to the high-RM environment; but then lighter as the developer dries out.

In FIG. 4, the above $V_o$ and $E_o$ results are graphed in terms of density sensitivity (transmittance density with reduction for losses through the photoconductor) over the tone scale. The effect of an uncompensated AM-UP at 75° F./75%RH is also graphed. The AM-UP effect has a fast initial decrease in transmission density over the first few hundred prints; then a slow effect in the opposite direction as the process approaches the steady-state dried-out condition at 8K prints. As shown in FIG. 4, the fast and slow effects are similar both lying between the curves featuring $V_o$ and $E_o$ effects. This indicated to the inventors that an appropriate predetermined ratio of $V_o$ and $E_o$ with automatic adjustments could yield more precise compensation of the AM-UP effect over the entire tone scale with reduced range requirements, compared to strategies where $V_o$ and $E_o$ are separately adjusted without regard to the other. The combined adjustments (both in the same direction) would be computed proportional to the deviation of measured $D_{MAX}$ from the $D_{MAX}$ setpoint as described above.

The $V_o/E_o$ combined adjustment disclosed herein provides for adjustment of both $V_o$ and $E_o$ based on measurement of a single step ($D_{MAX}$) in the tone scale, thus minimizing the number of process control patches. The measure and adjust cycle may be repeated with a high patch frequency to achieve a fast setup, or a low frequency to regulate a slowly drifting process. The $V_o$ and $E_o$ adjustments are in a fixed ratio (about 2:1) and found empirically to provide good compensation of tone scale disturbances, i.e., environmental and rest-run effects. The noted ratios is applicable where the units of $V_o$ are volts and the units of $E_o$ are expressed in digital values (or counts) from 0 to 255 as described for use in $G_{REF}$ and the patent literature. Obviously, different ratios will apply for different types of systems and expressions used for $V_o$ and $E_o$. Simultaneously, a feed-forward loop adjusts $V_B$ to maintain a fixed difference between measured $V_o$ and $V_B$ which maintains a clean background and minimizes developer pickup.

Figure 5:
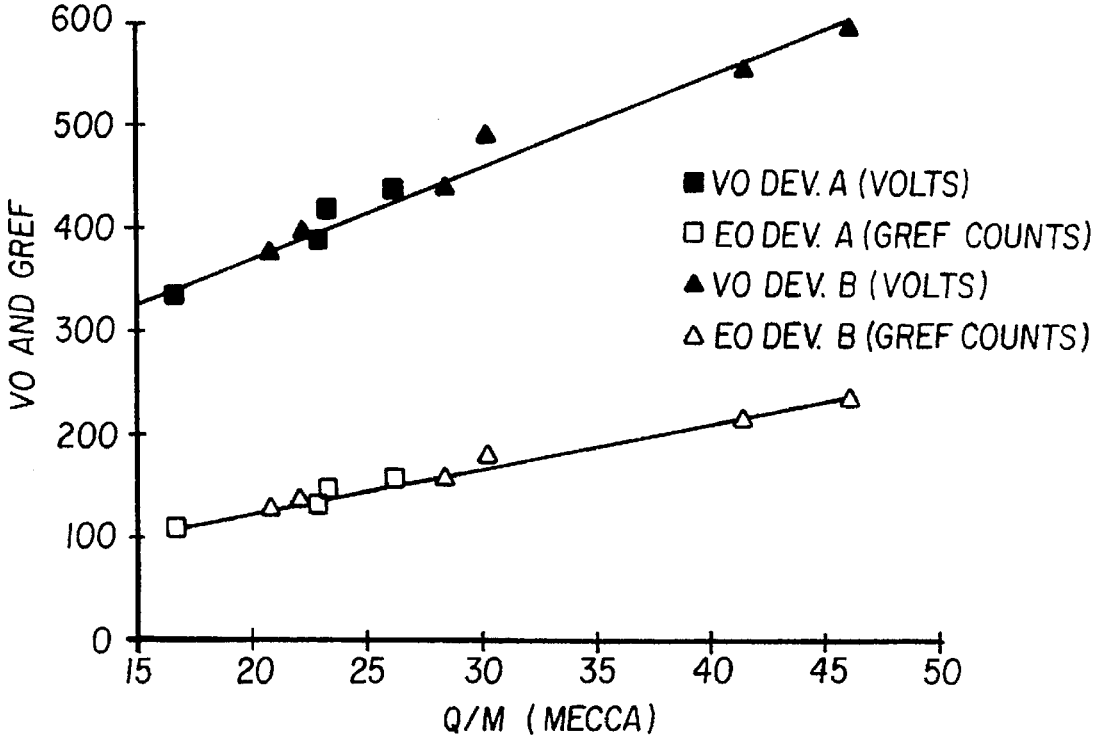
FIG. 5 is a graph illustrating correlation over an entire tone scale between a fixed $V_o/E_o$ adjustment ratio in accordance with the invention and a range of charge-to-mass ratios of two different toners.

This strategy has been tested with an unheated developer in AM UP and steady-state in 70° F./50%RH, 75° F./75%RH and 80° F./10%RH environments. To address the question of whether the same fixed $V_o/E_o$ ratio is robust over batch-to-batch variations, the algorithm was tested further with a second developer of a different formulation over the same ranges of duty-cycle and environment. Even though the developers have opposite environmental sensitivities, and the first developer has a generally higher Q/M (charge to mass ratio) the use of the described combined adjustment strategy did a reasonably good job of regulating the entire tone scale with the second developer. Further improvements for both developers might be attainable by slightly increasing the fixed ratio of $k_2/k_1$ to 2.2 again wherein $V_o$ is in volts and $E_o$ is expressed in digital values for $G_{REF}$ that vary from 0 to 255. The $V_o$ and $E_o$ adjustments of all this testing showed good correlation with the Q/M measurements, as shown in FIG. 5. This FIG. 5 may be used to translate Q/M variation into corresponding $V_o$ and $V_o$ range requirements. Advantageously, range requirements for both $V_o$ and $E_o$, according to our invention, are significantly less than the range requirements where only one of $V_o$ and $E_o$ are adjusted.

There has thus been described an improved apparatus and method for process control in an electrophotographic process wherein adjustments to $V_o$ and $E_o$ are generated using a fixed ratio ($k_2/k_1$) in calculating changes to parameters used to generate new values of $V_o$ and $E_o$.

Although the preferred embodiments have been described with reference to formation of a test area as a patch that is formed in an interframe area, the invention also contemplates creation of one or more test areas within an image frame for reading of density for use in controlling $E_o$ and $V_o$ in accordance with the steps described herein.

The invention has been described in detail with particular reference to preferred embodiments thereof and illustrative examples, but it will be understood that variations and modifications can be effected within the spirit and scope of the invention.

We claim:

1. A reproduction apparatus comprising:

an electrostatic recording member for supporting an electrostatic image;

charging means for establishing a primary charge on the member, the primary charge being defined by a parameter $V_o$;

exposure means for image-wise modulating the primary charge to form an electrostatic image on the recording member and having an exposure parameter $E_o$;

developer means for developing the electrostatic image; and control means for controlling adjustments to the parameters $E_o$ and $V_o$ by measuring a density parameter $D_{OUT}$ of an exposed and developed area that is formed by operation of said charging means, said exposure means and said developer means, said control means including means for calculating an error, $\Delta D_{OUT}$, in the measured density parameter from a density setpoint and multiplying $\Delta D_{OUT}$ by first and second constants to obtain respective adjustment values used for adjusting $E_o$ and $V_o$ and wherein in repeated use of said control means to provide repeated adjustment values used for adjusting $E_o$ and $V_o$ a fixed ratio is maintained between said first and second constants.

2. The apparatus of claim 1 wherein the adjustment value for $V_o$ represents a change in a set point of $V_o$.

3. The apparatus of claim 2 wherein the change in the set point of $V_o$ is used to adjust a voltage potential on a grid of the charging means.

4. The apparatus of claim 3 wherein the adjustment value for $E_o$ is used to adjust a current to an electronic exposure element on said exposure means.

5. A method of controlling reproduction of images comprising the steps of:

(a) charging an electrostatic recording member with a primary charge defined by a parameter $V_o$;

(b) modulating the primary charge on the recording member with an exposure device to form an exposed test area, the exposure device having an exposure parameter $E_o$;

(c) developing the exposed test area; and (d) controlling adjustments to the parameters $E_o$ and $V_o$ by measuring a density parameter $D_{OUT}$ of the exposed and developed test area, calculating an error, $\Delta D_{OUT}$, in the measured density parameter from a density setpoint, and multiplying $\Delta D_{OUT}$ by first and second constants to obtain respective adjustment values used for adjusting $E_o$ and $V_o$; and (e) repeating steps (a) through (d) to provide repeated adjustment values used for adjusting $E_o$ and $V_o$ wherein in the repeating of steps (a) through (d) a fixed ratio is maintained between said first and second constants.

6. The method of claim 5 wherein the adjustment value for $V_o$ represents a change in a set point of $V_o$.

7. The method of claim 6 wherein the change in the set point of $V_o$ is used to adjust a voltage potential on a grid of a primary charger.

8. The method of claim 7 wherein the adjustment value for $E_o$ is used to adjust a current to an electronic exposure element that is used to reproduce images.

9. The method of claim 5 and after adjusting $V_o$ and $E_o$ adjusted values of $V_o$ and $E_o$ are used to reproduce images of documents.

10. The method of claim 9 wherein the adjustment value for $V_o$ represents a change in a set point of $V_o$.

11. The method of claim 10 wherein the change in the set point of $V_o$ is used to adjust a voltage potential on a grid of a primary charger.

12. The method of claim 11 wherein the adjustment value for $E_o$ is used to adjust a current to an electronic exposure element that is used to reproduce images.

13. The method of claim 9 and wherein said test area is exposed and developed to form a maximum density test area.

14. The method of claim 13 wherein the adjustment value for $V_o$ represents a change in a set point of $V_o$.

15. The method of claim 14 wherein the change in the set point of $V_o$ is used to adjust a voltage potential on a grid of a primary charger.

16. The method of claim 15 wherein the adjustment value for $E_o$ is used to adjust a current to an electronic exposure element that is used to reproduce images.

* * * * *